United States Patent [19]

Hsiung

[11] Patent Number: 4,577,906

[45] Date of Patent: Mar. 25, 1986

[54] ARMCHAIR WITH KNOCKED DOWN FRONT LEGS

[76] Inventor: Shu-Jen Hsiung, No. 549, Hsin-Shu Rd., Hsin-Chuang, Taipei Hsien, Taiwan

[21] Appl. No.: 626,375

[22] Filed: Jun. 29, 1984

[51] Int. Cl.[4] ..... A47C 7/00

[52] U.S. Cl. ..... 297/440; 297/445

[58] Field of Search ..... 297/440, 445; 403/260, 403/406, 407

[56] References Cited

U.S. PATENT DOCUMENTS

| | | | |
|---|---|---|---|
| 693,197 | 2/1902 | White | 297/440 X |
| 4,008,971 | 2/1977 | Wah | 430/260 X |
| 4,261,665 | 4/1981 | Hsiung | 403/260 X |
| 4,280,269 | 7/1981 | Marini | 403/260 X |

FOREIGN PATENT DOCUMENTS

| | | | |
|---|---|---|---|
| 1497965 | 1/1978 | United Kingdom | 403/260 |

*Primary Examiner*—James T. McCall

*Attorney, Agent, or Firm*—Flehr, Hohbach, Test, Albritton & Herbert

[57] ABSTRACT

An armchair includes a back, a pair of siderests and front legs, which are secured together by fasteners in a position for using, and can be disassembled for being stored, shipped, and so on, or replacing one part thereof with a part equivalent in function but different in style. The fasteners include bolts and cylindrical members each having horizontal thread hole for screwing with the shank of a bolt, and vertical pin hole for the insertion of a locking pin, the bolt and cylindrical members are provided on two abutting parts to be joined together. Dowel pins which maintain the relative position of two parts temporarily before that two parts are secured by the bolts and cylindrical members, and wood screws obliquely inserted into two joined parts for further securing them.

1 Claim, 4 Drawing Figures

ARMCHAIR WITH KNOCKED DOWN FRONT LEGS

BACKGROUND OF THE INVENTION

This invention relates to an armchair and particularly concerns an armchair with a dismountable front leg frame.

Some kinds of chairs such as the upholstered armchair and the high-backed armchair usually having graceful outlines are bulky and heavy since the usage thereof resorts to the features of stability and firmness. Therefore, it is rather inconvenient to pack, store or ship the same, and thus causes increases to the cost of marketing.

On the other hand, in order to comply with the different preferences of customers, the furnisher usually manufactures one style of chair in different appearances and the difference may only be ornamental, such as the shape of the legs or the siderests. Therefore, a knock-down chair of such kind made with or more parts capable of being taken apart and replaced by equivalent part(s) of different shape to permit change of appearance is desirable.

SUMMARY OF THE INVENTION

With the above in view, it is a general object of this invention to provide a knocked down armchair.

It is a further object of the invention to provide an improved manner of assembling a knocked down armchair.

These and other objects are accomplished by the parts, constructions and arrangements of the present invention, stated in general, an armchair according to this invention includes a back, a pair of armrests secured to the back, and a front leg frame mounted to the pair of armrests, in which the back, the pair of armrests and the front leg frame being assembled in a knocked down manner, the means for fastening the back, the pair of armrests and the front leg frame including a bolt member having a head at one end and a screw thread at the other end; a cylindrical member provided with a first hole with thread for screwing with the screw of the bolt, and a second hole extending in perpendicular direction of the first hole; a locking pin for being inserted into the second hole to lock the cylindrical.

The above and still further objects, features and advantages of the present invention will become more apparent as this description with reference to the accompanying drawings proceeds.

DETAILED DESCRIPTION OF THE PREFERRED EMBODIMENT

Figure 1:
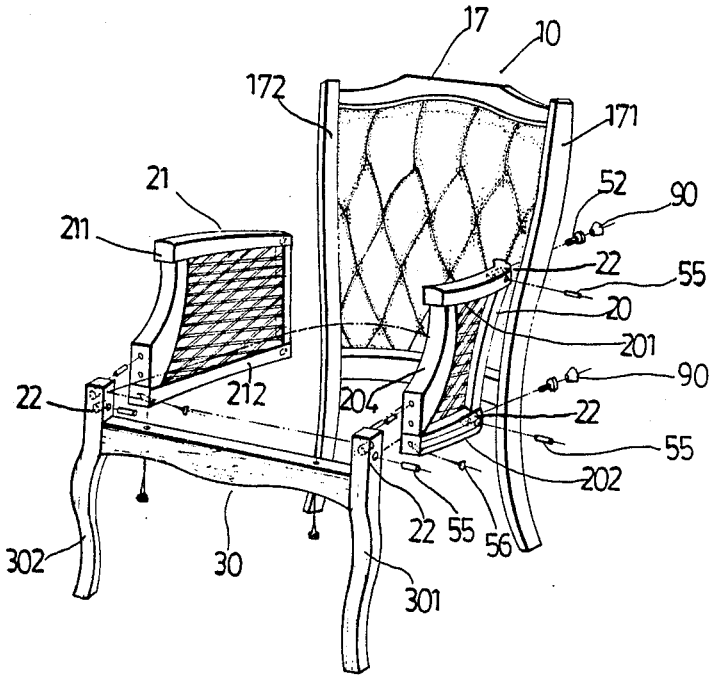
FIG. 1 is a schematical view illustrating the assembling of the back, armrest and front legs of a knocked down armchair according to a preferred embodiment of this invention.
Figure 2:
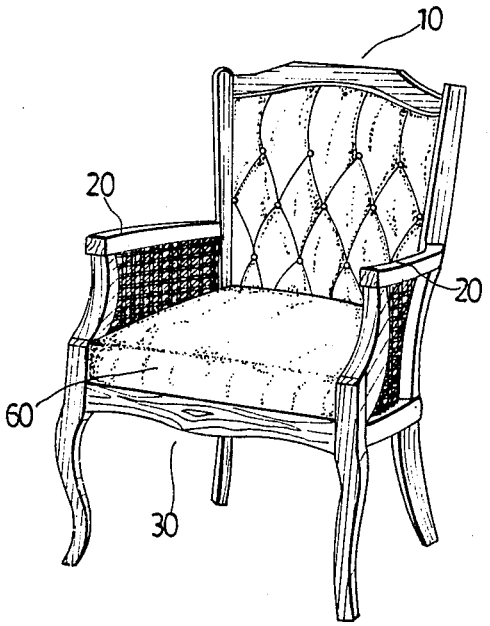
FIG. 2 is a perspective view showing the assembled armchair.

Referring now to FIG. 1, the frame of an armchair according to this invention and the fasteners to join the parts of the frame are shown disassembled, including a back 10 having an inverse U-shaped frame 17 having two downwardly extending rear legs 171, 172, a pair of armrests 20, 21 secured to the inverse U-shaped frame 17 and a front leg frame 30 secured on the front end of the siderests 20, including two front legs 301, 302. As shown in this figure, the back 10, armrests 20, 21 and front leg frame 30 are assembled in a knocked down manner by means of specialized fasteners.

Figure 3:
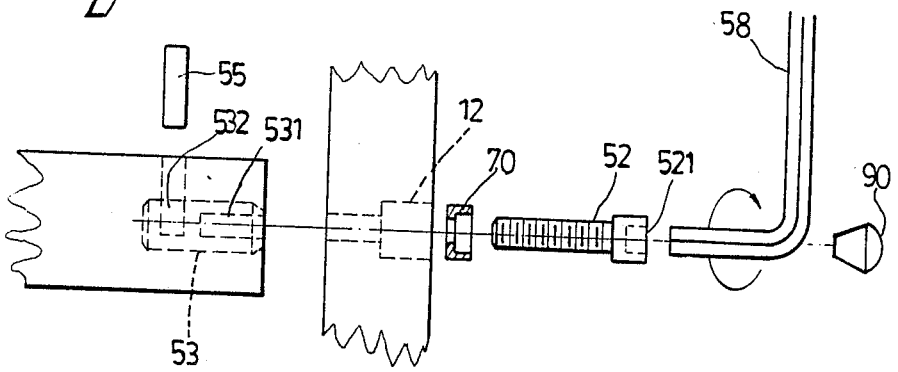
FIG. 3 is a schematic view showing the locking means for joining two adjacent parts of the armchair according to this invention.

The fasteners include three types, bolts, dowel pins and wood screws. The features thereof and the use of the same are illustrated in FIG. 3 and FIG. 4.

Figure 4:
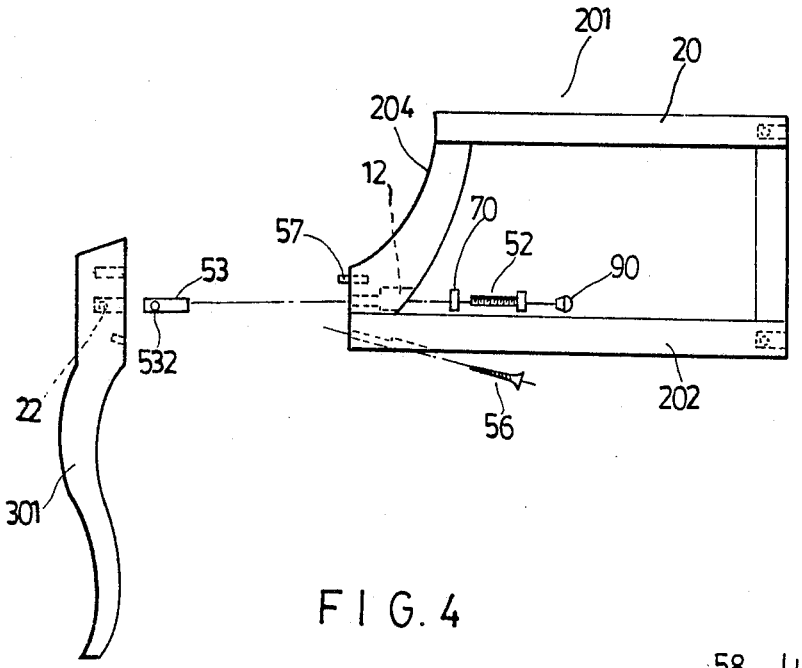
FIG. 4 is an enlarged schematic view showing the joining of the armrest and the front legs of the armchair according to this invention.

As can be seen in FIG. 4, prebored holes 22 are located at the respective rear end of the upper and lower cross bars 201, 202 and the respective upper end of the front legs 301, 302, the vertical section of the holes 22 are L-shaped. The cylindrical members 53, made with an outer diameter substantially equal to the diameter of the horizontal section of the L-shaped holes, are glued within the holes 22. As more clearly shown in FIG. 3, specifically, the cylindrical member 53 is fabricated as having a thread hole 531 for inserting of the shank portion of a bolt 52, and a vertically pin hole 532 for receiving a locking pin 55 to position the cylindrical member 53.

The other two types of fasteners will be described as the description of mounting the knocked down chair proceeds.

Referring again to FIG. 3, taking the right side siderest 20 as reference, while assembling the back 10 and the siderest 20, the cylindrical member 53 should be installed in the holes 22 on the upper cross bar 201 and lower cross bar 201 at first, with the pin hole 532 registered with the vertical section of the L-shaped hole 22, and thus a metal locking pin 55 can be inserted therein and therefore locking the cylindrical member 53 into position.

Thereafter, the bolt 52 can be screwed into a positioning hole 12 on the rear legs 171, 172 in alignment with the thread hole 531 and screwed therewith, to improve the tightness, preferably, a washer 70 is placed in the shoulder portion of the positioning hole 12. The bolt 52 having a recess 521 on the head thereof, that makes the same easily being tightened with the aid of a small wrench 58. In this embodiment, the depth of the recess 521 is greater than the thickness of the head of the bolt 52, so that when the bolt 52 has screwed into the thread hole 531, the recess 521 is not filled up and a sunken portion left on the surface. To make the appearance look better, a caulking piece 90 made of similar wood material is used to fill up the recess 521.

Referring to FIG. 4, to assemble the siderests 20 with the front leg frame 30, taking the righ-hand side siderest 20 and right front leg 301 as reference, these two parts should be firstly maintained in a proper relative position by dowel pins 57, then with the sleeve member 53, the bolts 52 are employed to secure them in a manner similar to what has been described hereinbefore, finally, wood screws 56 are obliquely screwed into the abutting portions of the siderests 20, and the front leg frame 30.

The back 10, the siderests 20 and the seat 60 may have any design, for example, they can be upholstered or have cane webbing surface bounded by the frames.

The combination of bolts, locking pins and wood screws provides a firm structure for the knocked down chair, nevertheless, the parts thereof, especially the front legs can be readily changed to any styles the customer desires. Furthermore, this invention permits the armchair to be sold in either pre-assembled or knocked down condition.

While the invention has been described in connection with what is presently considered to be the most practical and preferred embodiments, it is to be understood that the invention is not to be limited to the disclosed embodiment, but on the contrary is intended to cover various modifications and equivalent arrangements included within the spirit and scope of the appended claims the scope of which is to be accorded the broadest interpretation so as to encompass all such modifications and equivalent structures.

I claim:

1. An armchair including a back having a pair of upright rear legs each being formed with a forward-facing flat mounting surface, a pair of armrests each being formed at its front and rear ends with respective forward-facing and rearward-facing flat mounting surfaces, a front leg frame having a pair of upright front legs each being formed with a rearward-facing mounting surface, fastener means for assembling said back, said pair of armrests and said front leg frame together as an armchair with the facing flat mounting surfaces of the back, armrests and front leg frame in abutting relationship to form respective joints, said fastener means further providing for disassembly of said back, said pair of armrests and said front leg frame in a knocked-down manner, said fastener means including a bolt member and a cylindrical member for each joint, each bolt member having a head at one end and a screw thread at the other end, means forming a first threaded hole in each cylindrical member for receiving the screw thread of the bolt member, means forming a second hole in each cylindrical member extending perpendicular to the longitudinal axis of the first hole, means forming cavities in the flat mounting surfaces of the back, armrests and front leg frame, each cavity being sized to seat a respective cylindrical member, and locking pin means for insertion into the second holes of each cylindrical member for locking such cylindrical member in the respective cavity.

* * * * *